US005816855A

United States Patent [19]

Pesson

[11] Patent Number: 5,816,855

[45] Date of Patent: Oct. 6, 1998

[54] HOLDING AND CONTACT ELEMENT AND CONNECTOR

[75] Inventor: Michel Pesson, Sille-Le-Philippe, France

[73] Assignee: Framatome Connectors International, Courbevoie, France

[21] Appl. No.: 740,964

[22] Filed: Nov. 5, 1996

[30] Foreign Application Priority Data

Nov. 7, 1995 [FR] France ..... 95 13149

[51] Int. Cl.[6] ..... H01R 13/73

[52] U.S. Cl. ..... 439/567

[58] Field of Search ..... 439/567, 571, 439/82, 751

[56] References Cited

U.S. PATENT DOCUMENTS

| | | | |
|---|---|---|---|
| 3,634,819 | 1/1972 | Evans . | |
| 4,701,984 | 10/1987 | Wyckoff | 24/573 |
| 4,784,550 | 11/1988 | Wollar | 411/32 |
| 5,106,328 | 4/1992 | Prochaska et al. | 439/751 |
| 5,336,111 | 8/1994 | Thrush et al. | 439/567 |
| 5,374,204 | 12/1994 | Foley et al. | 439/82 |
| 5,564,954 | 10/1996 | Wurster | 439/82 |

FOREIGN PATENT DOCUMENTS

| | | |
|---|---|---|
| 0 141 492 | 5/1985 | European Pat. Off. . |
| 0 213 968 | 3/1987 | European Pat. Off. . |

*Primary Examiner*—Gary F. Paumen
*Attorney, Agent, or Firm*—Perman & Green, LLP

[57] ABSTRACT

The invention concerns a plug-in holding and contact element of an electrical connector or a solderless electrical contact terminal piece, particularly for coupling a connection element onto a printed circuit. Plug-in holding element (1) comprises a pin furnished with a slot over a portion of the shaft constituting this pin, the slot defining branches (2, 3) of arched longitudinal shape and solid section. The invention also concerns a connector equipped with such an element.

5 Claims, 6 Drawing Sheets

HOLDING AND CONTACT ELEMENT AND CONNECTOR

BACKGROUND OF THE INVENTION

1. Field of the Invention

The invention concerns a holding and contact element that can be plugged in, or a solderless electrical contact, notably for coupling a connection element onto a printed circuit.

2. Prior Art

Solderless electrical contact terminals are known from documents U.S. Pat. No. 3,634,819 and EP 0 141,492.

In the document U.S. Pat. No. 3,634,819, a contact pin comprised of a cylindrical shaft in which flattened spring branches are produced in arched form is described.

In the document EP 0,141,492, a flat pin also comprises spring branches arched toward the outside crosswise to the axial contact direction.

In these documents, an electrical contact between a pin and the inner cylindrical wall of a metallized opening of a printed circuit is obtained by elastic support of the spring branches of the pin on the inner surface of the metallized opening. Connectors using such contacts plugged into the printed circuit eliminate the need for a pin soldering step.

These devices, well adapted to an electrical connection for small signals, do not offer good characteristics for mechanical holding and are sensitive to a misalignment of the pin and the opening.

In order to improve the hold of the connector, an additional holding device for the connector onto the printed circuit is generally produced either by devices furnished with arms by "harpoons" whose holding element is comprised of a spring hook provided with external projections or teeth, which are gripped in the inner wall of a metallized hole of the printed circuit.

A harpoon hook of this type is known from document U.S. Pat. No. 5,154,634. The use of such a hook as a ground contact is frequent, but the connection made is by means of teeth placed in the metallized layer of the hole which thus form point contact zones, which, on the one hand, are not favorable for an efficacious ground continuity and which, on the other hand, risk deteriorating over time. This generally leads users to conduct a resoldering of this element, thus canceling any interest in using a connector with solderless contacts.

In all cases, this holding device is not designed for making power contacts.

SUMMARY OF THE INVENTION

The present invention proposes creating an element, which can be plugged in and which offers a large retaining surface that permits, on the one hand, a robust holding of the connector and, on the other hand, a reliable connection over time capable for making a power contact or a ground contact.

To do this, the holding and electrical contact element that can be plugged in according to the invention is made up of a pin provided with a slot on a portion of the shaft making up this pin, this slot defining branches of longitudinal arched shape, at least one of the branches defined by this slot having a solid section whose outer wall has a transverse profile shaped like an arc of a circle of variable radius, depending on the longitudinal position of the section considered.

Preferably, the slotted portion is bounded on its upper end by a rigid base and on its lower end by a joining piece, the piece and the base defining the ends of the shaft.

The base can advantageously make up the inner surface of a flange extended by a connection piece for joining with a complementary connection element.

In one particular mode of embodiment, the inner walls of the branches extend along a direction parallel to the axis of the shaft.

More particularly, the branches can each comprise an inner wall with an arc of a circle transverse profile of constant radius along the length of the branches.

Moreover, the branches can have lateral parallel planar walls.

The invention also concerns a connector element for a printed circuit comprising an insulating component for receiving electrical contacts, these electrical contacts being provided, on the one hand, with a coupling terminal for a contact supported by a complementary connector element and, on the other hand, with a terminal for coupling onto the printed circuit, the terminal for coupling onto the printed circuit of at least one of said contacts being comprised of an element that can be plugged in according to the invention so as to create a power connection.

It also concerns a connector element for a printed circuit of the shielded envelope type for which one or more elements that can be plugged in according to the invention make a ground connection between the shielding envelope and a metallized hole of the printed circuit.

The solid section of the branches that can be plugged in according to the invention gives the advantage of working the branches by plastic deformation and permits a residual application of pressure of the wall of the metallized hole with possible penetration.

The branches can be deformed into a parallelogram between their points of coupling to the flange and their points of coupling to the joining piece, which allows compensating for a possible misalignment of the plug-in element relative to the metallized hole of the printed circuit.

BRIEF DESCRIPTION OF THE DRAWINGS

Other characteristics and advantages of the invention will appear more clearly upon reading the description that follows in connection with the drawings, which show.

DETAILED DESCRIPTION OF THE PREFERRED EMBODIMENTS

Figure 1A:
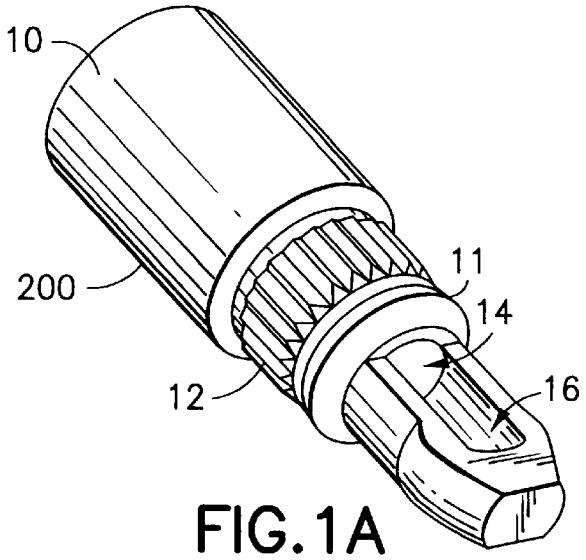
In FIGS. 1-A and 1-B, a perspective view of a holding and contact element that can be plugged in according to two variants of embodiment of the invention, In FIGS. 2-A, 2-C and 2-D, respectively, a partially cutaway surface view, an outer side view and a bottom view of a holding and contact element that can be plugged in according to the invention, FIG. 2-B is a cross section of the branches of the holding element according to the invention, FIGS. 3-A and 3-B show the section of the branches inserted into a printed circuit.
Figure 1B:
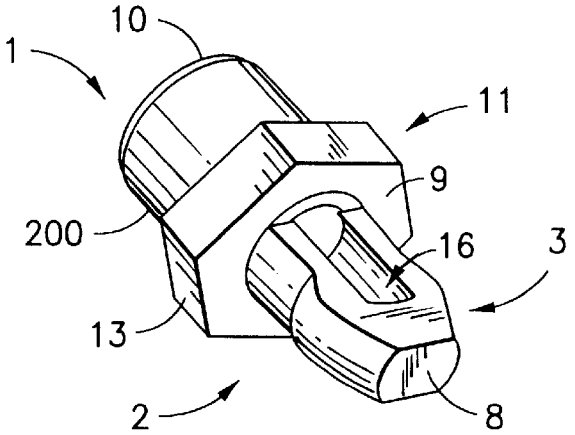
Figure 2A:
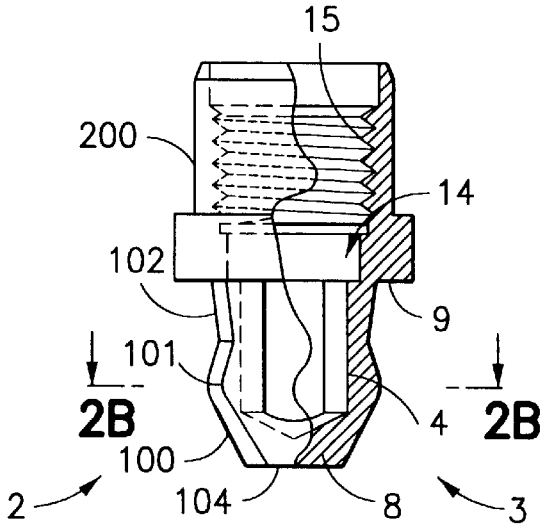
Figure 2B:
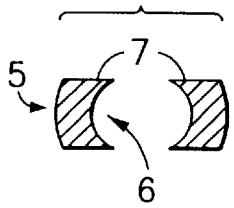
Figure 2C:
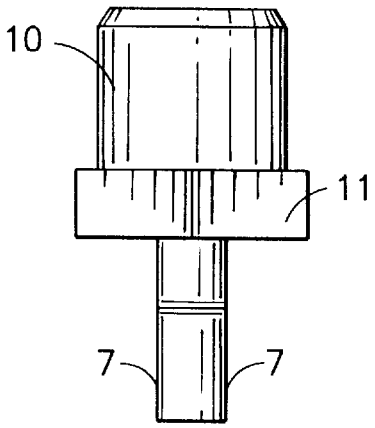
Figure 2D:
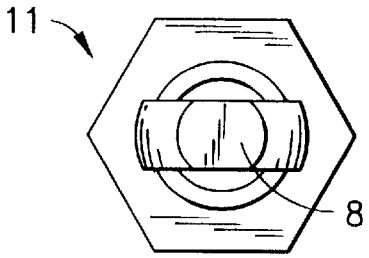

In FIGS. 1-A and 1-B, the holding element 1 that can be plugged in is comprised of a pin 200, of a generally cylindrical shape. This pin 200 comprises an upper tubular part 10, a central part forming a flange 11 and a lower part in the form of a shaft comprising two branches 2,3 separated by a slot 16 and connected by a terminal piece 8. The flange comprises a lower surface 9 to which are coupled branches 2 and 3, this surface 9 thus forming a base for branches 2 and 3. In FIG. 1-B, the flange comprises faces 13, while in FIG. 1-A, flange 11 continues in the direction of the upper part of an indented zone 12 with longitudinal serrations; the function of faces 13 and the serrated zone 12 will be explained with regard to FIGS. 4 and 5.

FIG. 2-A, shows a side view, partially cutaway, along a vertical plane passing through the longitudinal axis of the holding element 1. It is seen in this figure that tubular pin 200 is provided with a borehole 14 opening up at the upper part of the pin 200, and that a slot 16 separates branches 2 and 3. Branches 2 and 3 each comprise an outer surface 5 and an inner surface 6, and the branches 2 and 3 have a solid section such that their elasticity is reduced to a minimum.

Referring also to FIG. 2-B, outer surface 5 of at least one of the pins has a transverse profile in the shape of an arc of a circle of variable radius depending on the longitudinal position of the section considered. The arc radius varies along the length of the branch considered to define a lower guiding zone 100 for insertion into a hole 31 of a printed circuit 30, a zone of widened section 101 for interference with the wall of hole 31 and an upper zone of reduced section 102 for coupling the branch with base 9.

In order to reduce even further their elasticity, the branches are coupled, at their insertion end 104, by a piece 8 for rigid joining.

Figure 3A:
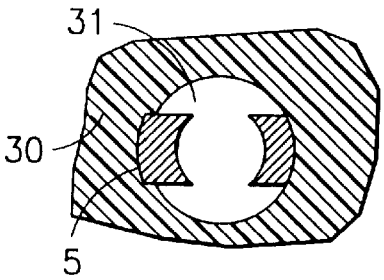
Figure 3B:
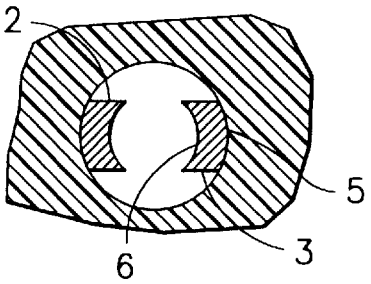

FIGS. 3-A and 3-B show the insertion of the branches 2 and 3 in a metallized hole 31 of a printed circuit 30, a metallized hole 31 connected in a manner known in and of itself with a metallized track of said printed circuit.

FIG. 3-A shows insertion of the branches 2 and 3 in the case of a hole of minimum diameter and a maximum shift of the axis of the hole 31 with the axis of the pin 200. FIG. 3-B shows the insertion of branches 2 and 3 in the case of a hole 31 of maximum diameter.

In order to clarify these ideas and by way of example, the diameter of a metallized hole for attaching a connector, commonly of 3 mm, can, as a function of the manufacturing tolerances, increase up to 3.20 mm. The metallization layer typically comprises a layer of 25 microns of copper covered with 5 microns of tin-lead. The shift tolerated between the axes of the hole 31 and the holding element 1 is 0.12 mm.

The holding element 1 corresponding to this drill hole 31 will have branches 2 and 3 whose widened sectional zone 101 (viewed in FIG. 2-B) will define a diameter of 3.25 mm and whose solid constitution will permit an insertion into the metallized wall by at least 0.05 mm, for the hole of maximum diameter, and up to an interference by 0.27 mm, for the hole of minimum diameter with maximum axial shift. The combined flattening of the branches 2 and 3 of the holding element 1 and the walls of the hole 31 prevents the tearing free of the metallization layer.

Figure 4:
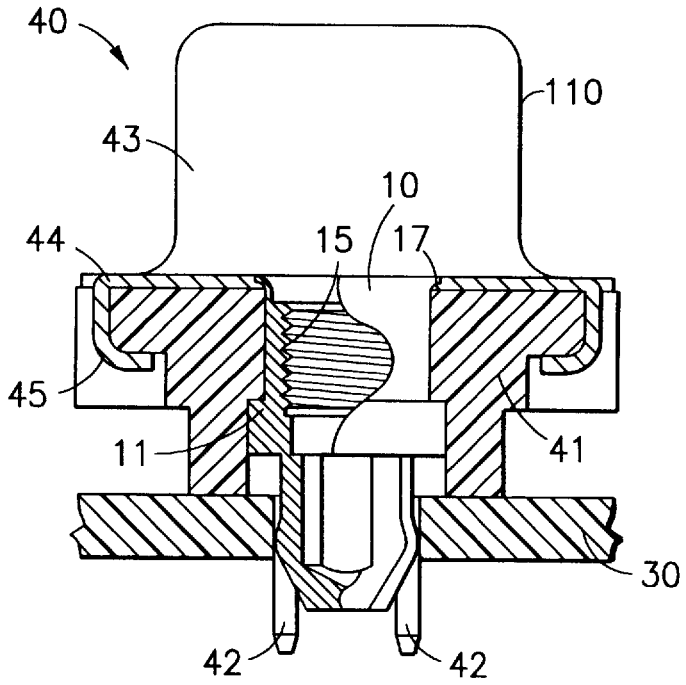
FIGS. 4 and 5 show a side view in partial section of a connector provided with a holding and contact element that can be plugged in according to the invention used for a ground-continuity terminal, In FIG. 6, a perspective view of a power contact comprising a holding and contact element according to a third variant of embodiment of the invention, In FIG. 7, a partial sectional view of a connector provided with a power contact according to FIG. 6, In FIGS. 8-A, 8-B, a sectional view of a connector provided with a power contact in two parts comprising a contact element according to the invention, In FIG. 9 a perspective view of a straight power contact in two parts comprising a contact element according to the invention, In FIG. 10 a connector provided with a power contact conforming to FIG. 9.
Figure 5:
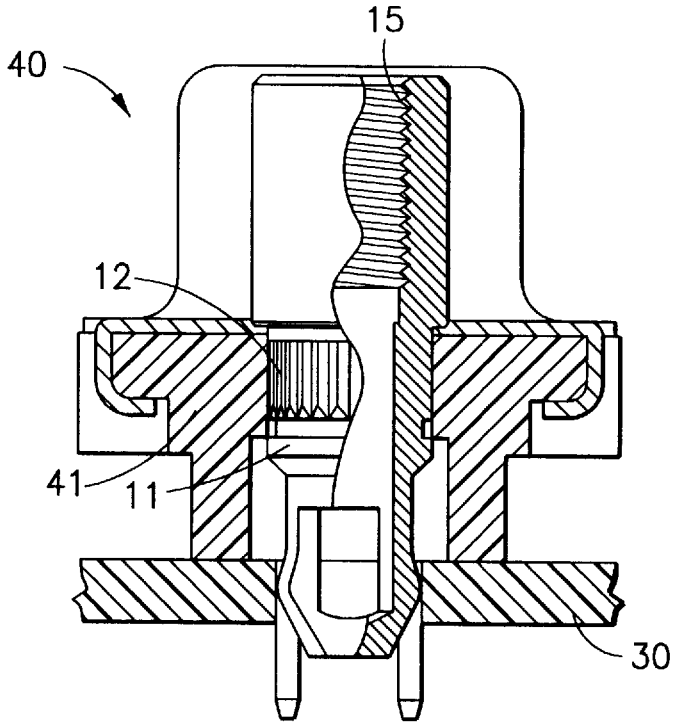

FIGS. 4 and 5 show one application of a holding element 1 according to the invention used as an attachment and ground connection piece for an electrical connector 40 onto a printed circuit 30.

The connector 40 comprises in a known manner an insulating component 41 supporting contacts provided with connection terminals 42 with strips of the printed circuit 30, and a metal shield 110 made up of a front shell 43, covering the lateral surfaces of the receiving part of a complementary connector (not shown), the metal shield 110 being provided with sides 44 and turned-under pieces 45, sides 44 and turned-under pieces 45 being of one piece with the metal shield 110 and entrapping the insulating component 41.

Such connectors are, for example, known under the tradename "SUB D".

In the application of FIG. 4 according to the invention, holding element 1 imprisons and holds metal shield 110 and insulating component 41 between its flange 11 and the upper turned-down edge 17 of its upper tubular part 10. The upper tubular part can be provided with an inner threading 15 permitting either the attachment of a complementary connector comprising holding screws, or the attachment of a coding means.

In the variant of FIG. 5, the attachment element has the serrated zone 12 interferingly plugged into the insulating component 41 of the connector 40 and flange 11 is supported against the lower edge of insulating component 41 of the connector 40.

The connector 40 thus provided with the holding element 1 is then inserted into the printed circuit 30, the holding element 1 assuring a ground continuity between the shield 110 and the printed circuit 30.

Figure 6:
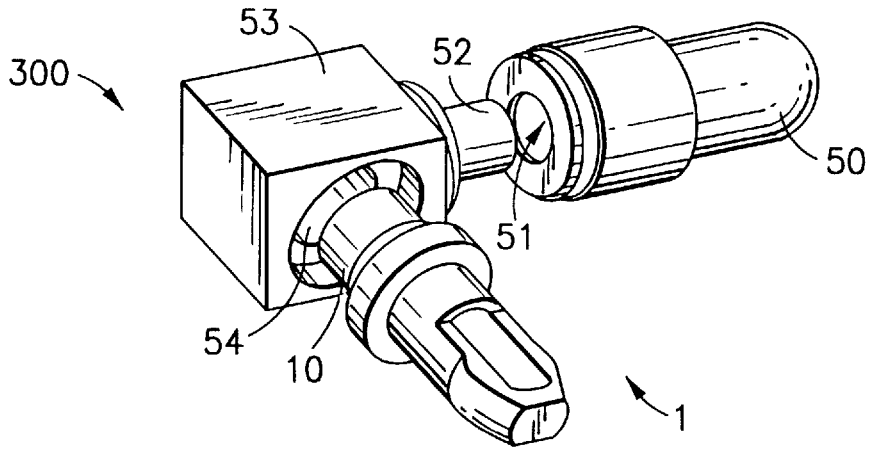
Figure 7:
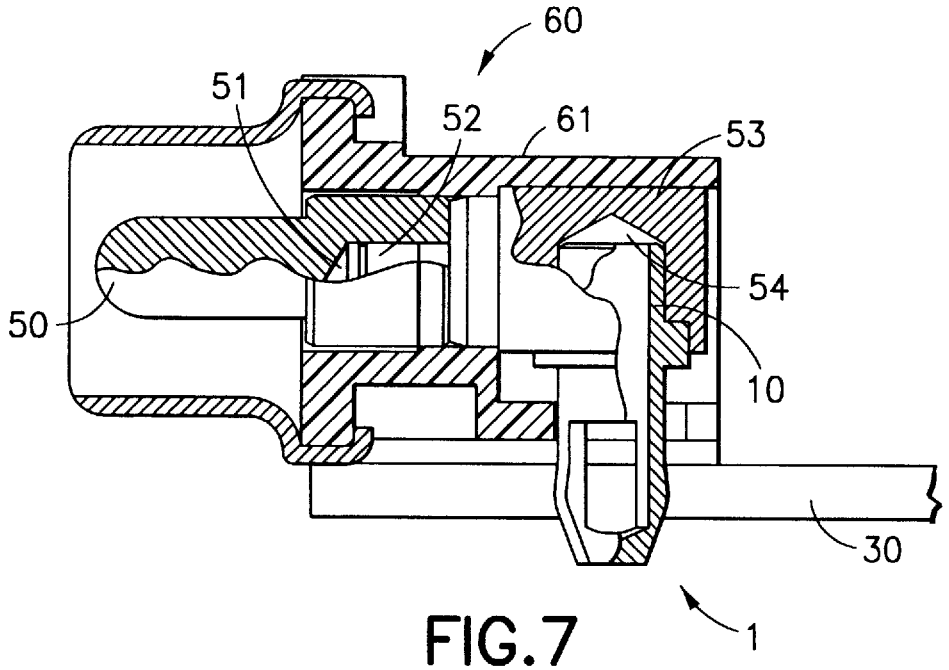

In FIGS. 6 and 7 are respectively shown a power contact 300 of the elbow type and a connector element 60 receiving this contact. The power contact 300 is constructed around a central block 53. Central block 53 is provided on its first surface with a tip 52 onto which is attached a terminal piece 50 for coupling with a contact supported by a complementary connector. Coupling terminal piece 50 which has a bore hole 51 in the rear part is inserted through the front into an opening of an insulating contact-support component 61. Central block 53 is inserted by its rear part into the opening of the insulating component 61 so that tip 52 is forcedly fitted into borehole 51 of terminal piece 50, thus holding tight insulating component 61. The central block thus has on a second surface a borehole 54 receiving tubular part 10 of an element 1. The power contact made up in this way is adapted to current passages of 30 amperes without the necessity of soldering the contact onto the printed circuit and, due to its structure, can hold the connector on the printed circuit. The production of a connector with straight contacts is possible by omitting the central block and simply wedging the rear tubular part 10 of plug-in element 1 into bore hole 51 of the coupling part.

Figure 8A:
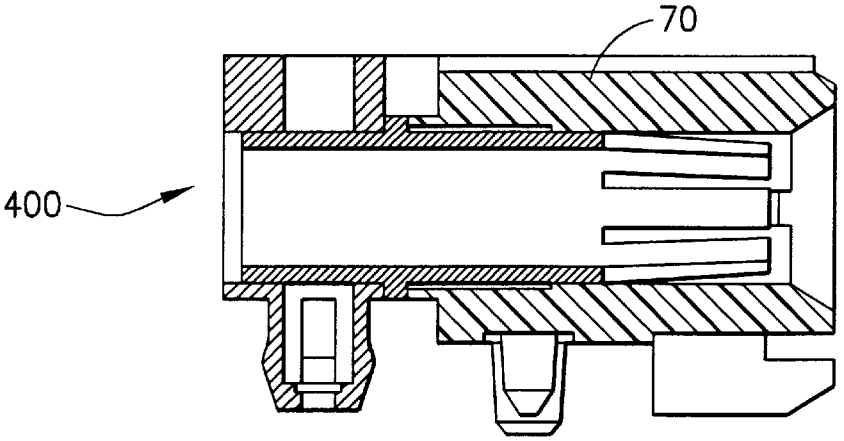
Figure 8B:
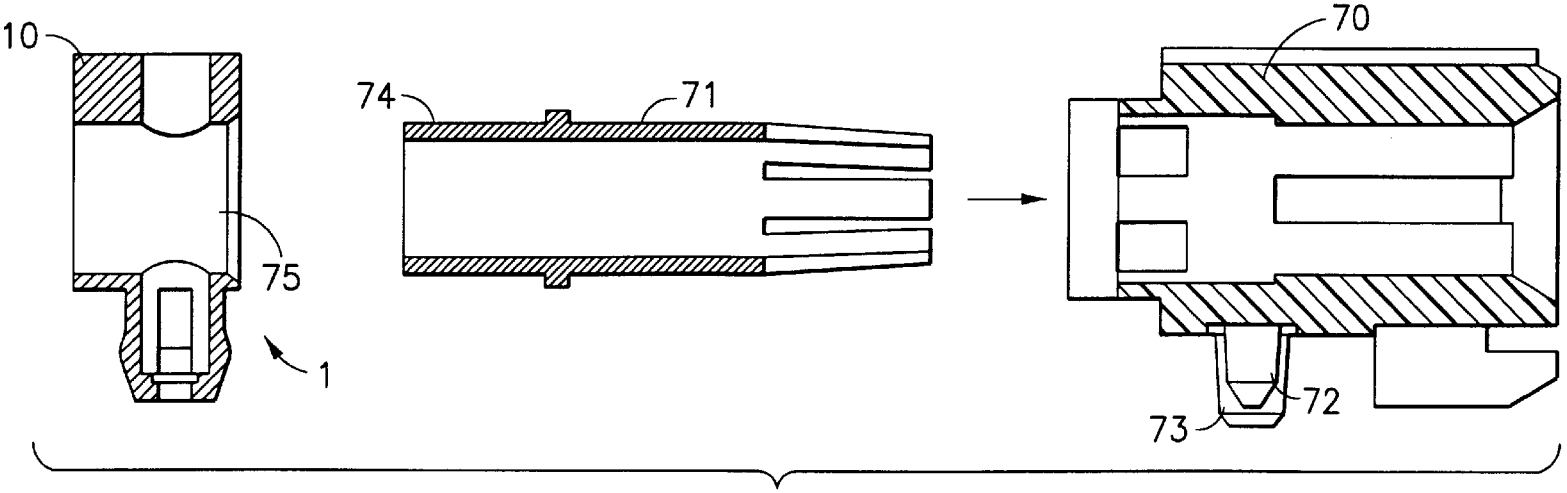
Figure 10:
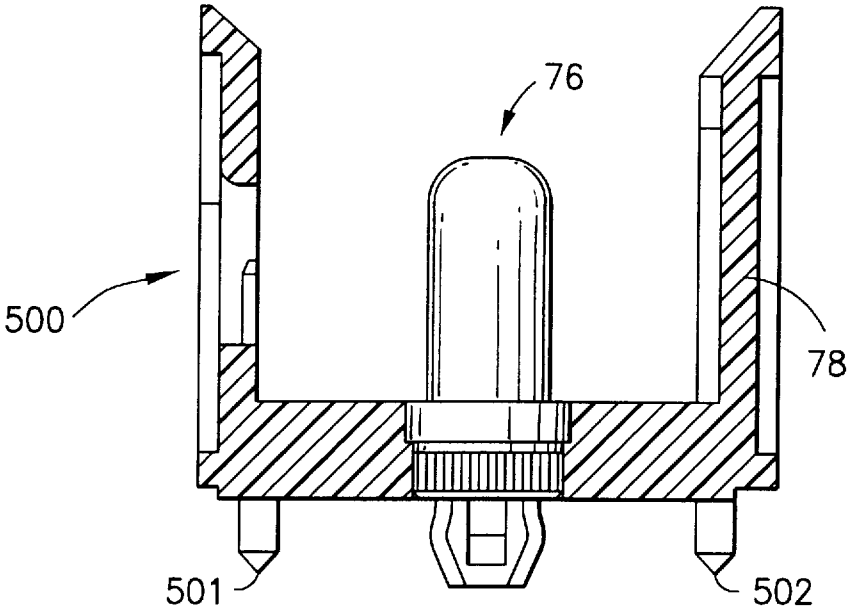
Figure 9:
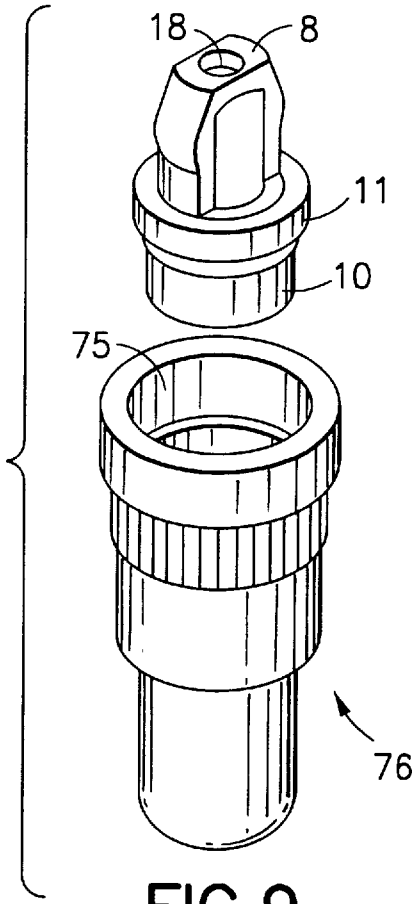

FIGS. 8A, 8B, 9 and 10 present different modes of embodiment of power contacts and connectors receiving them. FIGS. 8A and 8B involves a connector 400 of the elbow type for which contact element 1 is coupled to a coupling terminal with a complementary contact of a connector (not shown). In FIG. 8B, the elements making up the connector 400; insulating block 70, coupling terminal 71 and contact element 1 are shown separated. For the coupling of contact terminal 71 with contact 1, a bore hole is made in part 10 of element 1, a bore hole in which the rear part 74 of coupling terminal 71 is plugged in. The power contact is held in the insulating piece by the front part of terminal 71. In order to produce the power contact used in the connector 500 of FIG. 10, rear part 10 of contact element 1 is plugged into a borehole 75 of contact terminal 76. For its insertion onto the printed circuit, connectors 400, 500 can be provided with centering and attachment pieces 72, 73, 501 and 502.

An element that can be plugged in according to the invention can advantageously be obtained by a first step of cutting a cylindrical bar to produce the outer shape of the pin, a second step of axial boring of the pin and a third step of milling the lateral surfaces of the pin branches, this last step creating slot 16 separating branches 2, 3. This milling step can be produced by means of straight cutters or shape cutters to give, respectively, either planar lateral surfaces 7 or inclined lateral surfaces or faces of any profile whatever. The inner walls 6 of the branches obtained by the drilling step are advantageously parallel along the length of the branches and are provided with a transverse profile in an arc of a circle of constant radius along the length of the branches in order to prevent any variation of the distance between the flange and the contact zone with the printed circuit during plugging in and increasing the rigidity of the branches. As a variant and in order to permitting flexing of the branches, it is possible to reduce the rigidity of piece 8 linking the branches, and for this purpose, the latter can be drilled with a hole 18 in its central part as shown in FIGS. 9A, 9B.

What is claimed is:

1. A combined holding and electrical contact element adapted to be plugged into another member, the combined element comprising a pin having a shaft, a portion of the shaft having a slot therein, the slot defining branches of the shaft, the branches having longitudinal arched shapes, wherein at least one of the branches has a solid section with an exterior outer wall having a cross-sectional shape of an arc of a circle with a radius of the arc that varies as a function of longitudinal position along the solid section, and wherein the branches have straight inner walls that extend along a direction parallel to an axis of the shaft, the inner walls of the branches each having a transverse profile in the form of an arc of a circle of constant radius along the length of the branches.

2. A combined element as in claim 1 wherein the portion of the shaft having the slot is bounded at an upper end by a rigid base and is bounded at a lower end by a joining piece, and wherein the rigid base and the joining piece define ends of the shaft.

3. A combined element as in claim 2 wherein the rigid base comprises a flange and a lower surface of the flange extended by a tip for joining to a complementary connection element.

4. A combined element as in claim 1 wherein the branches have planar lateral walls.

5. A combined element as in claim 2 wherein the joining piece has a central part with a hole therein.

* * * * *

UNITED STATES PATENT AND TRADEMARK OFFICE

CERTIFICATE OF CORRECTION

PATENT NO. : 5,816,855

DATED : Oct. 6, 1998

INVENTOR(S) : Pesson

It is certified that error appears in the above-identified patent and that said Letters Patent is hereby corrected as shown below:

Column 6, add the following claims:

--6. A connector element for a printed circuit member, the connector element comprising an electrical contact and an insulating component receiving the electrical contact, the electrical contact having a first end with a terminal piece for coupling to a contact supported by a complementary connector element and a second end with a plug-in element for coupling onto the printed circuit member, wherein the plug-in element is a combined holding and electrical contact element according to claim 1 that forms a power connection.

7. A connector element for a printed circuit member comprising an insulating component for receiving an electrical contact, a shielding element, and a plug-in element, the plug-in element comprising a combined holding and electrical contact element according to claim 1 that forms a ground connection between the shielding element and a metallized hole of the printed circuit member--.

Signed and Sealed this

Second Day of February, 1999

*Attest:*

*Attesting Officer*

*Acting Commissioner of Patents and Trademarks*